United States Patent [19]

Wilson

[11] Patent Number: 4,701,970

[45] Date of Patent: Oct. 27, 1987

[54] HIGH SPEED FLOOR BUFFING MACHINE AND FLOOR BUFFING PAD

[75] Inventor: William H. Wilson, Sparta, N.C.

[73] Assignee: Pioneer/Eclipse Corp., Sparta, N.C.

[21] Appl. No.: 847,526

[22] Filed: Apr. 3, 1986

Related U.S. Application Data

[63] Continuation-in-part of Ser. No. 632,235, Jul. 19, 1984, Pat. No. 4,598,440.

[51] Int. Cl.[4] ..... A47L 11/164

[52] U.S. Cl. ..... 15/98; 15/230.16; 15/230.18; 15/410

[58] Field of Search ..... 15/98, 230.16, 230.18, 15/385, 410

[56] References Cited

U.S. PATENT DOCUMENTS

| | | | |
|---|---|---|---|
| 935,558 | 9/1909 | Spangler | 15/385 X |
| 1,093,820 | 4/1914 | Beach | 15/385 X |
| 1,763,365 | 6/1930 | Nobbs | 15/385 X |
| 1,857,240 | 5/1932 | Dittmar | 15/98 X |
| 2,415,372 | 2/1947 | Salt et al. | 15/385 |
| 2,668,976 | 2/1954 | Beach | 15/230.16 |
| 2,828,499 | 4/1958 | Horst | 15/98 |
| 2,949,619 | 8/1960 | Holt | 15/49 R |
| 3,354,488 | 11/1967 | Bilde | 15/98 X |
| 3,445,877 | 5/1969 | Stout | 15/98 |
| 3,619,849 | 11/1971 | Jones | 15/322 X |
| 3,678,532 | 7/1972 | Boyd | 15/236 C |
| 4,178,654 | 12/1979 | Mitchell | 15/385 |
| 4,307,480 | 12/1981 | Fallen | 15/230.18 |
| 4,322,866 | 4/1982 | Brazzale | 15/98 X |
| 4,358,868 | 11/1982 | Cook | 15/49 R |

*Primary Examiner*—Chris K. Moore

*Attorney, Agent, or Firm*—Wigman & Cohen

[57] ABSTRACT

A high speed floor buffing machine equipped with a pad holder for an X-shaped buffing pad is disclosed. The arms of the pad holder have a wedge-shaped cross section that acts as an air foil to create air currents that flow up between the arms of the buffing pad. The casing surrounding the pad has a specially designed tunnel-like spiral diffuser that guides the air currents into a collection box. The casing also has a flexible skirt mounted to the lower edge thereof, extending around three-quarters of the casing periphery, and closing the gap between the casing and the floor. The chassis has two pair of wheels and is designed so that when the buffing machine is off, the machine rests entirely on the wheels with the buffing pad raised off the floor, and when the machine is on, the air currents urge the pad against the floor with a predetermined pressure. Alternate embodiments of the pad holder are disclosed.

6 Claims, 13 Drawing Figures

FIG. 9
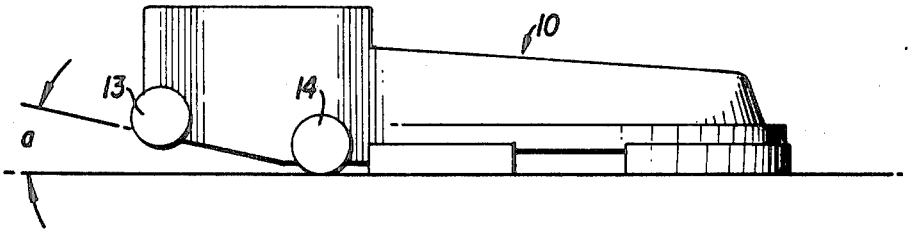
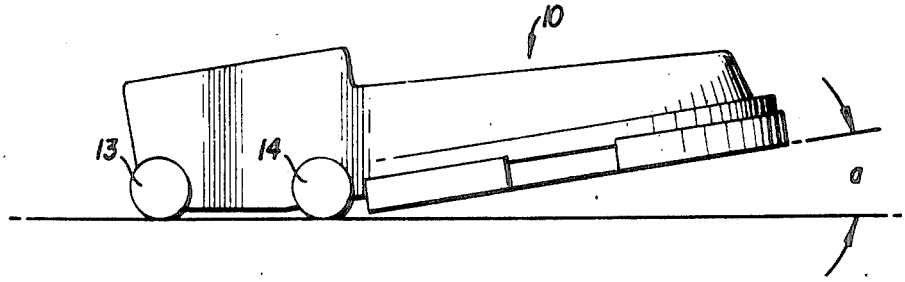
FIG. 8

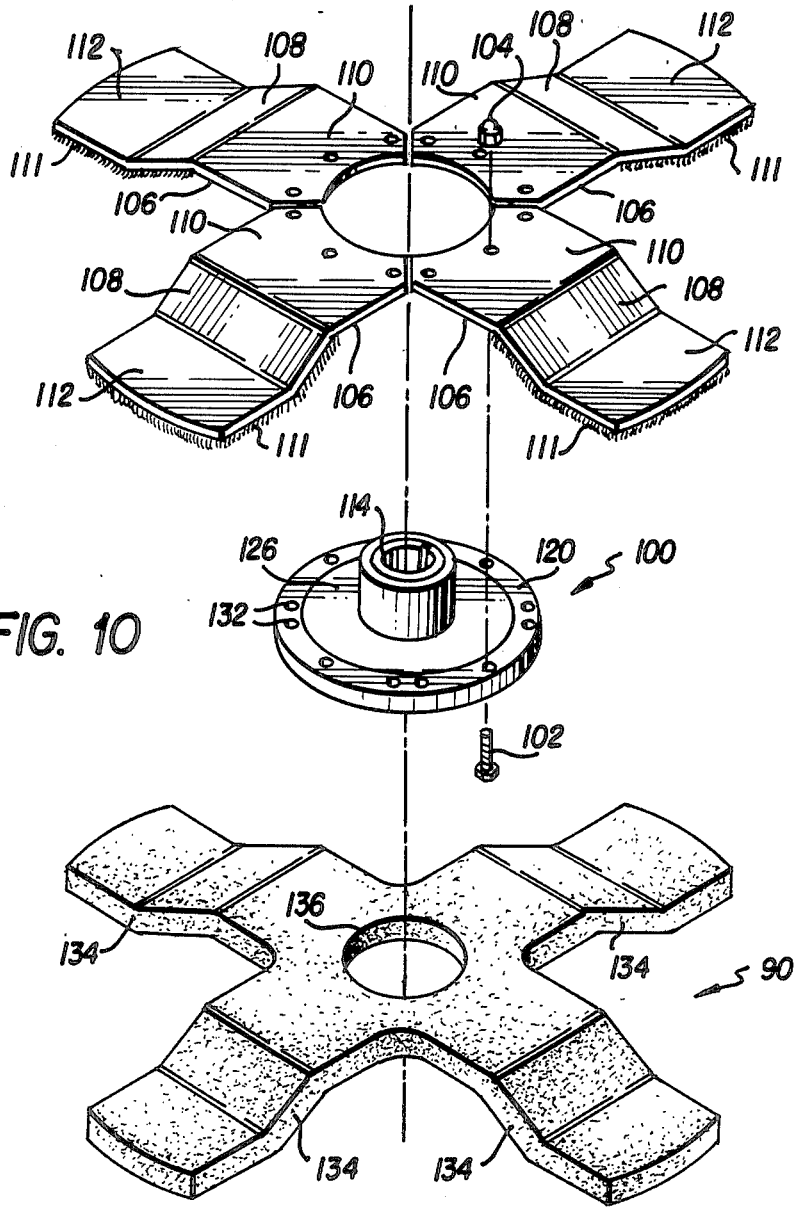
FIG. 10
FIG. 11
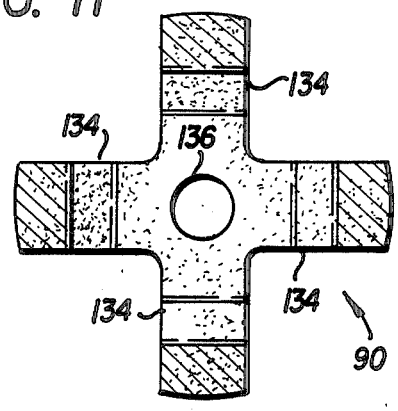
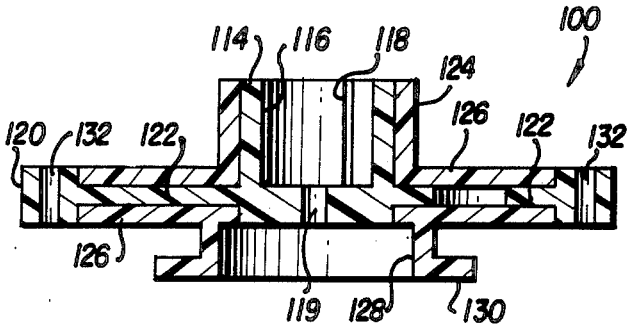
FIG. 12

HIGH SPEED FLOOR BUFFING MACHINE AND FLOOR BUFFING PAD

CROSS-REFERENCE TO RELATED APPLICATION

This application is a continuation-in-part of application Ser. No. 632,235 filed July 19, 1984, now U.S. Pat. No. 4,598,440.

BACKGROUND OF THE INVENTION

The present invention relates to floor buffing machines, and more particularly to a unique, high speed floor buffing machine utilizing a specially designed buffing pad and pad holder for reducing motor load and for controlling dust and debris.

A search of the prior art failed to uncover any prior art reference which discloses the high speed buffing machine of the present invention. The following patents were uncovered which disclose buffing machines or similar rotary equipment of varying design and complexity: U.S. Pat. Nos. 548,201; 3,417,420; 3,619,954; 3,974,598; 4,148,110; 4,358,868; and 4,365,377.

U.S. Pat. Nos. 548,201; 3,417,420; and 3,619,954 disclose a sweeping brush, buffing pad and sanding disc, respectively, having a generally X-shaped configuration. However, because of the material or design, none of those buffing pad devices are suitable for high speed floor buffing.

U.S. Pat. Nos. 3,974,598 and 4,148,110 each disclose rotary scraping or sanding tools having air foil blades mounted on the rotary discs for expelling dust and debris from a workpiece. Those devices are also not suitable for buffing, particularly for floor buffing, because they are too small and are suitable only for scraping or sanding.

The following additional U.S. patents were cited by the examiner in the parent application Ser. No. 632,235, now U.S. Pat. Nos. 4,598,440:

| | | |
|---|---|---|
| 935,558 | 2,415,372 | 3,678,532 |
| 1,093,820 | 2,668,976 | 4,178,658 |
| 1,763,365 | 2,949,619 | 4,307,480 |
| 1,857,240 | 3,619,849 | 4,322,866 |

Conventional floor buffing equipment utilizes flat, circular buffing pads, which, when powered by an electric motor, revolve at speeds usually between about 175 and 1000 RPM, although some operate at speeds as high as 2000 RPM. For a standard electric motor to operate a conventional buffing pad at the high range of rotational speed, only a slight pressure can be exerted upon the floor by the pad without straining the motor or causing the motor to draw excessive current.

In order to obtain a superior finish on a waxed floor when dry buffing, i.e., buffing a previously waxed floor without adding new wax, it is necessary to generate enough friction and heat to actually melt the top layer of wax on the floor. The amount of friction and the resulting heat generated is proportional to the rotary speed at which the buffing pad operates and the pressure the pad exerts on the floor.

However, the load and resulting power draw of an electric buffing machine motor depends, not only on the combination of the speed at which the pad rotates and the pressure exerted on the floor by the pad, but also on the area of contact between the buffing pad and the floor, i.e., the size of the buffing pad. Since the power draw of a conventional electric buffing machine motor is limited to what can reasonably be supplied from a 110-volt wall outlet, there is a finite limit to the size or area of a buffing pad that can generate sufficient friction and heat to actually melt the top layer of wax. With state-of-the-art electric motors, only a small area pad of conventional, i.e., circular, design can achieve a superior finish. Since a small area pad would result in a prohibitively long time to buff a large floor, conventional electric floor buffing machines are not designed to operate at speeds and pressures high enough to achieve a superior finish on waxed floors in a reasonable time. In essence, quality of finish is generally sacrificed for speed.

A further problem with the conventional circular buffing pads is that they generate a significant amount of air currents and loose debris. Unfortunately, the air currents are not well directed and usually blow the loose debris away from the buffing machine to generally inaccessible areas, such as underneath shelving and tables where it is difficult to collect.

OBJECTS AND SUMMARY OF THE INVENTION

In view of the foregoing limitations and shortcomings of the prior art devices, as well as other disadvantages not specifically mentioned above, it should be apparent that there exists a need in the art for a floor buffing machine that is capable of buffing large floor surface areas efficiently with a superior finish. It is also apparent that there is a need in the art for a floor buffing machine that is designed to collect the loose debris generated by the buffing operation, rather than to expel it from the machine.

It is, therefore, a primary object of this invention to fulfill that need by providing a floor buffing machine that is capable of buffing large floor surface areas efficiently and with sufficient friction to achieve a high quality finish on the wax being buffed.

Another object of the present invention to provide a buffing pad of a unique design that permits an electric buffing machine to develop adequate friction between the pad and floor over an adequate surface area without straining the motor or causing the motor to draw excessive current.

It is another object of the present invention to provide a buffing pad and buffing pad holder that create a vacuum effect for collecting loose dirt.

It is yet another object of the present invention to provide a buffing machine that is designed such that the pad pressure on the floor is automatically controlled by suction created by the pad holder.

Yet another object of the present invention to provide a buffing machine that collects the loose debris created by the buffing process by means of controlled air currents generated by the machine.

Still another object of the present invention to provide a casing for a buffing machine that is designed to direct air currents in such a manner that loose debris is collected and guided into a collection box.

It is still a further object of the present invention to provide a buffing machine that is designed such that proper buffing pressure is always exerted by the pad on the floor to be buffed.

Briefly described, the aforementioned objects are accomplished according to the invention by providing a buffing machine, preferably electric, which is equipped with an X-shaped buffing pad having a diameter similar to a conventional circular buffing pad, but with much less surface area than the conventional pad. Because of the reduced surface area, the X-shaped pad can be rotated at higher speeds than conventional pads. The pad holder is similarly X-shaped and has four arms with a wedge-shaped cross section that functions as an air foil to create air currents that flow upwardly between the arms of the X-shaped pad and pad holder. In an alternative design of the pad holder, the four arms each have an intermediate, downwardly inclined portion which provides only a small contact area between the floor and pad at the outermost extremity of each arm thereby permitting even higher rotational speeds of the buffing machine.

The casing surrounding the pad has a depending flexible skirt mounted to the lower edge thereof which extends around three-quarters of the casing periphery and which closes the gap between the casing and the floor. The X-shaped pad, pad holder and skirting cause the air currents to collect loose dirt and direct it into a specially designed tunnel-like region in the casing that guides the air currents and dirt into a collection box. A handle is mounted to the casing in a pivotable manner so that the operator is prevented from exerting excess pressure on the pad.

The machine has two sets of wheels, one located at the rear of the machine and the other located in an intermediate position directly behind the buffing pad. When the machine is off, it is balanced so that the machine rests on all four wheels, with the buffing pad raised above the floor and inclined at a slight angle. When the machine is turned on, the vacuum effect created by the pad holder pulls the buffing pad onto the floor with a predetermined force. In that position, the weight of the machine is distributed between the buffing pad and the set of wheels located directly behind the pad and the rear wheels are located in a raised position above the floor.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 8 is a side elevation view of the machine in the "off" position;

FIG. 9 is a side elevation view of the machine in the "on" position;

FIG. 10 is an exploded perspective view of an alternate embodiment of an X-shaped pad holder and X-shaped pad;

FIG. 11 is a bottom plan view of the alternate embodiment of the X-shaped buffing pad of FIG. 10; and FIG. 12 is a side elevation view in cross-section of the hub arrangement of the pad holder shown in FIG. 10.

DETAILED DESCRIPTION OF THE PREFERRED EMBODIMENT

Figure 1:
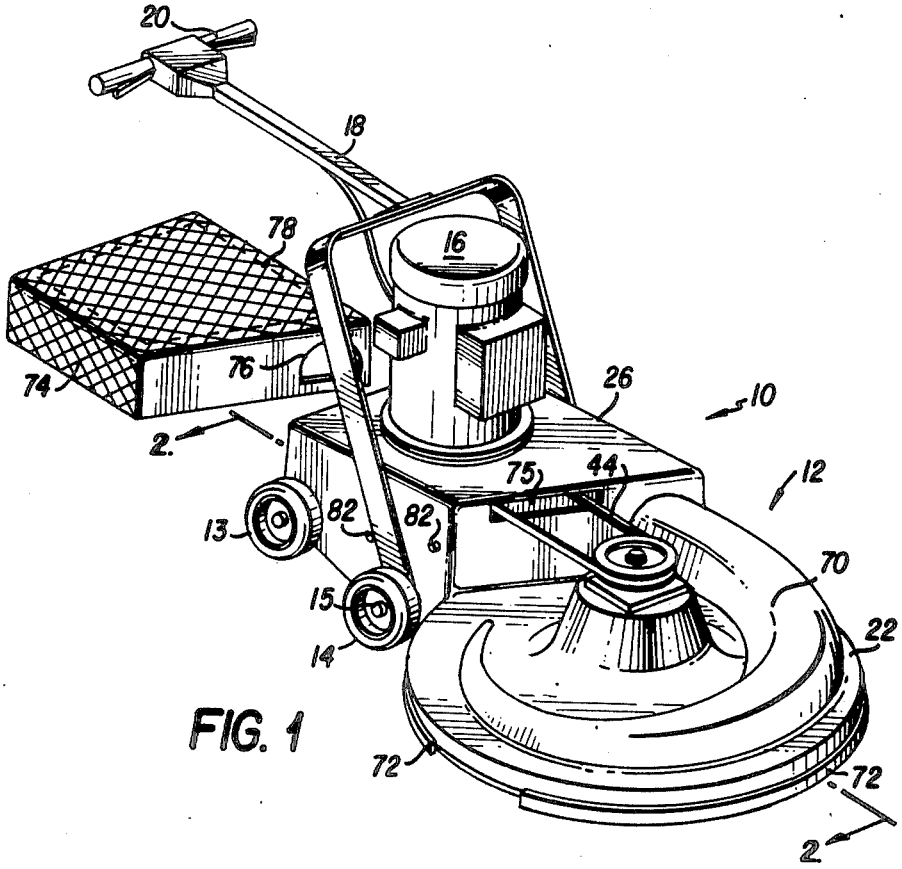
FIG. 1 is a perspective view of an electric buffing machine according to the present invention.
Figure 2:
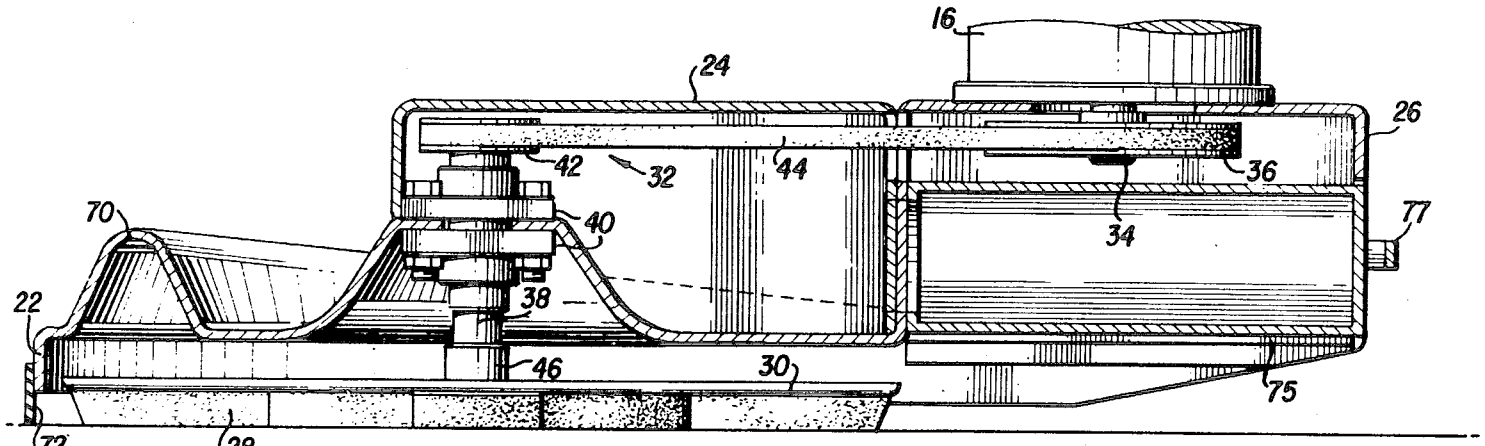
FIG. 2 is a side elevation view of the buffing pad and transmission, partly in section, taken along line 2—2 of FIG. 1.
Figure 3B:
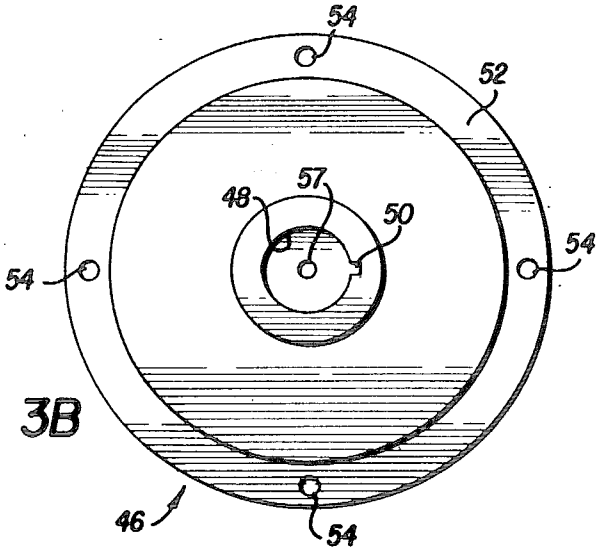
FIG. 3B is a top plan view of the hub arrangement for the pad holder of the buffing machine of the present invention.
Figure 3A:
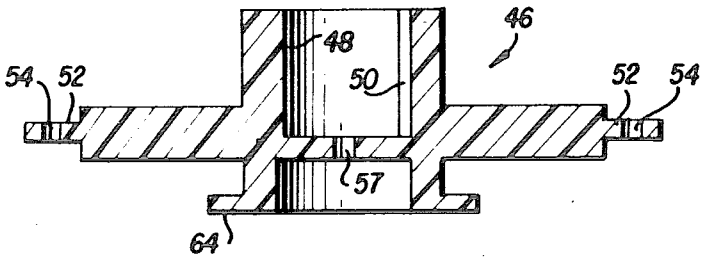
FIG. 3A is a side elevation view in cross-section of the hub arrangement for the pad holder of the buffing machine of the invention.
Figure 7:
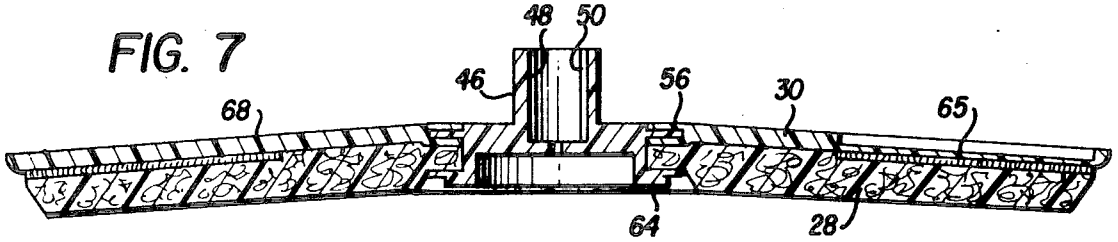
FIG. 7 is a side elevation view of the pad holder taken along line 7—7 of FIG. 5.

Referring now in detail to the drawings, there is shown in FIG. 1 a perspective view of a floor buffing machine 10 according to the present invention. As seen in FIG. 1, the buffing machine 10 includes a chassis 12, two pair of wheels 13, 14, an electric motor 16, and a handle 18 with electric motor controls 20. The chassis 12 comprises two separate sections, the pad housing or casing 22, and the motor housing 26. A belt cover 24 (not shown in FIG. 1) fits over the pad casing 22 and is partially shown in FIG. 2. Enclosed within the chassis 12 are a buffing pad 28, a pad holder 30, and a transmission means 32 for driving the buffing pad 28, which components can be more clearly seen in FIGS. 2–7.

The transmission means 32 includes a drive shaft 34 extending from the motor 16 into the motor housing 26 of the chassis 12. A drive pulley 36 is fixedly mounted to the drive shaft 34. Arranged parallel to the drive shaft 34 is a driven shaft 38 rotatably mounted to the casing 22 by bearings 40. A pulley 42 is rigidly mounted to the driven shaft 38 above the casing 22 of the chassis 12 and is connected to the drive pulley 36 by a drive belt 44, such as a conventional V-belt.

At the lower end of the driven shaft 38, below the chassis bearings 40, there is rigidly mounted a hub 46. The hub 46 has a bore 48, into which the shaft 38 fits. A key (not shown) from shaft 38 fits into a keyway 50 within the bore, and rotationally secures the shaft to the hub. A bolt (not shown) extends through an opening 57 in the hub and engages in a threaded bore (not shown) within the shaft 38 to further secure the shaft 38 to the hub 46.

The pad holder 30 is manufactured in a dual molding process. The hub 46 is a one-piece unit the comprises the shaft-engaging bore 48, a flanged support 64 that is used to secure the buffing pad 28 to the pad holder 30, and an annular mounting flange 52 extending circumferentially from the hub 46. The mounting flange 52 has small holes 54 extending through it adjacent the outer periphery thereof, for facilitating the securing of the hub 46 to the outer arm portion 56 of the pad holder. The outer arm portion 56 comprises a circular inner section 59 and four arms 68, and is molded directly onto the mounting flange 52 and through holes 54 to form one unitary piece.

The outer arm portion 56 is made of a rigid, high molecular weight plastic, while the hub 46 is made from a semi-flexible plastic, such as polyethylene. The semi-flexible plastic allows the pad holder 30 to universally pivot in any direction with respect to the shaft 38. That enables the buffing pad 28 to float over uneven floor surfaces without disrupting the alignment of or creating excessive lateral forces on the shaft 38, bearings 40, drive pulley 36 and pulley 42.

The buffing pad 28 is about twenty inches across its maximum dimension and is preferably made from rubberized, loosely-spun, polyester fibers. The pad 28 has a central circular portion 58, from which four equiangularly spaced arms 60 extend, thereby forming an X-shaped pad. In the center of the pad, a hole 62 is provided and is sized to fit over a flanged support 64 (see FIG. 7) on the pad holder 30. A layer of Velcro-like fabric having hooks 65 is attached to the pad holder 30 for fastening the pad 28 to the pad holder 30. The Velcro-like fabric hooks firmly engage directly with the fibers of the pad in a manner similar to the conventional Velcro loop material.

Figure 6:
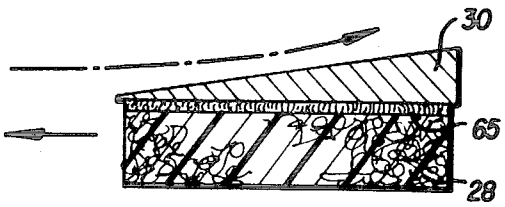
FIG. 6 is a side elevation, in cross-section, of one arm of the X-shaped pad holder and pad taken along line 6—6 of FIG. 5.
Figure 5:
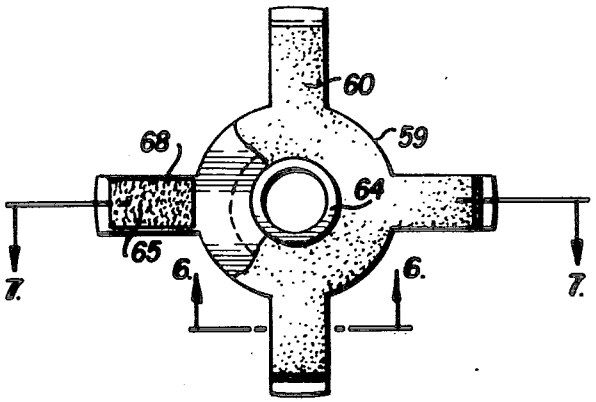
FIG. 5 is a bottom view of the X-shaped buffing pad holder and pad, partly broken away.
Figure 4:
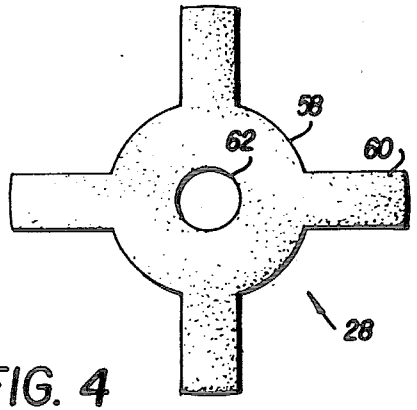
FIG. 4 is a top plan view of the X-shaped buffing pad.

The pad holder 30 is slightly concave (see FIG. 7) to allow the ends of the pad arms 60 to firmly contact the floor surface. It is important that the ends of the pad are in firm contact with the floor, because it is the ends that determine the width of the buffed path. The arms 68 of the pad holder 30 are also wedge-shaped in cross-section in the manner of an air foil, as best seen in FIG. 6. The air foil shape causes air to be deflected upwardly through the openings between the arms of the pad and pad holder.

An alternate embodiment of the X-shaped pad holder of the invention for the buffing machine 10 is illustrated in FIGS. 10–12. In the exploded perspective view of FIG. 10, the pad holder comprises a hub arrangement 100 to which is secured four radially extending arms 106 by means of bolts 102 and nuts 104 (three for each arm). The arms 106 are molded of a rigid, high molecular weight or high impact plastic and are formed with intermediate, inclined portions 108 connecting the inner portions 110 and outer portions 112 of the arms. The inner portions 110 of the arms extend substantially horizontally from the hub arrangement 100 (when the axis of the latter is vertically oriented) and the outer portions 112 are preferably inclined slightly downwardly from the horizontal plane to insure that the outermost tips of the buffing pad 90 engage the floor to be buffed.

The underside of each arm 106 confronting the buffing pad 90 is provided with a strip 111 of the Velcro-like material described above from a point closely adjacent the tips of the arms radially inwardly to a point adjacent the horizontal portions 110 of the arms and extending substantially the entire width of the arms.

Hub arrangement 100 is constructed in a similar manner as pad holder 30, that is, as a dual molding of a rigid high molecular weight plastic and a flexible or semi-flexible plastic or elastomer. As shown in FIG. 12, hub 100 comprises a cylindrical hub element 114 with an axial bore 116, keyway 118 and hole 119 corresponding to bore 48, keyway 50 and hole 57 of hub 46 shown in FIGS. 3A and 3B. Hub element 114 also comprises an outer annular ring 120 integrally formed in one-piece therewith by connecting, circumferentially extending perforate web 122, or a plurality of radial ribs or a combination of both. Ring 120 is provided with a plurality of holes 132 for securing the arms 106 thereto. Hub element 114 is preferably formed of a rigid, high molecular weight plastic.

A flexible or semi-flexible plastic or elastomer is molded over hub element 114 to form an outer cylindrical sleeve 124 around hub element 114, and a circumferentially extending flange 126 on both sides of perforate web 122. A cup-like element 128 is also formed beneath the hub element 114 integrally with the flange 126 and has an annular flange or lip 130 corresponding to flange 64 of hub 46. As will be appreciated by those skilled in the art, the dual-molded hub arrangement 100 described above advantageously provides a universal flexure or pivot joint between the hub element 114 and the annular ring 120 to permit the pad 90 to "float" over uneven floor surfaces to be buffed.

Buffing pad 90 is preferably formed of the same material as pad 28, or other non-woven fiber material and is die cut from flat sheet stock having a thickness of about $\frac{3}{4}$ inch to $1\frac{1}{2}$ inches, and preferably about 1 inch. As seen in FIG. 11, the one-piece pad has four radial buffing elements 134 and a central hole 136. The outermost tips of the pad are preferably arcuate and have the same curvature as a circular pad having the same diameter as the tip-to-tip distance of oppositely extending pad elements. One form of the pad comprises a 1-inch thick pad formed of rubberized, non-woven polyester fibers with about a 20-inch tip-to-tip dimension and a $4\frac{1}{2}$ to 5-inch width of the radial buffing elements.

To install the pad 90 on hub 100, the central hole 136 is stretched over the flange 130 and/or the flange 130 is deformed to pass through hole 136, the radial elements 134 are aligned with arms 106 and then pressed against the Velcro-like material strips 111 to secure the same. Only the outermost portions (about one-quarter to one-half) of the radial pad elements 134 engage the floor during buffing thereby advantageously reducing the load on the electric motor 16 and providing the greatest circumferential pad velocity for achieving a more rapid heating and melting of the top layer of wax on the floor, and thus a quicker buffing time and a better quality, higher gloss finish.

The casing 22 of the chassis comprises at its upper side a spiral diffuser 70, i.e., a half-round tunnel-like channel (see FIG. 1). A flexible skirt 72 is dependingly mounted at the lower edge of the pad casing 22 and extends around all but a small portion of the casing periphery. The skirt 72 prevents loose dust and dirt from being blown away from the buffing machine 10, while the spiral diffuser directs the air currents and loose debris in a spiral motion and into the motor housing 26 of the chassis 12.

A discharge collection box 74 is slidably mounted on tracks 75 within the motor housing 26. The collection box 74 is rectangular in shape and has an opening 76 on the front side thereof. When the box 74 is in place within the housing 26, the opening 76 is in alignment with an equally sized opening (not shown) in the motor housing 26 and with the adjacent large end of the spiral diffuser 70. Thus, in operation, air currents and loose dirt drawn upwardly by the air foil-like pad holder arms are guided through the spiral diffuser 70 and opening 76 into the discharge collection box 74. A handle 77 is connected to the side of the box opposite opening 76.

An air dispersal bag 78 is mounted within the collection box 74. The box 74 is made from expanded or perforate metal on the top and side surfaces. Thus, the air dispersal bag 78 disperses the air through the collection box 74, while retaining the dust and preventing it from being blown into the atmosphere.

It has been found that the discharge collection box of the buffing machine may be omitted by securing the air dispersal bag 78 over the end of a tubular terminal end (not shown) of the spiral diffuser 70. In a preferred form, the neck of the air dispersal bag is provided with an elastic band for securing it over the tubular end of the spiral diffuser.

The handle 18 for the buffing machihe 10 is pivotably mounted, preferably to the wheel axle 15. Stops 82 are mounted on the motor housing 26 for limiting the pivoting motion of the handle 18. The handle arrangement allows the machine 10 to be pushed or pulled horizontally, but does not allow the operator to put additional pressure on the buffing pad by lifting up on the handle because the handle will simply pivot forward instead of transferring the pressure to the pad. The weight or pressure on the pad 28 is very important in that too much weight on the pad will cause the motor to draw too much power, and too little weight will not allow the pad 28 to generate sufficient friction and heat to adequately buff the floor to a superior finish. The relative position of the motor 16 and the axle for the wheels 14 is designed to effect the proper weight distribution and load on the buffing pad. Therefore, it is important that the handle be designed such that the operator cannot easily alter the pressure on the pad.

In another form of the buffing machine, the forwardmost stop 82 may be eliminated entirely thereby making it impossible for the operator to apply excessive pad pressure by pivoting the handle 18 upwardly and forwardly toward the pad, unless the operator pivots the handle to the point where the handle rests on the casing and moves to the front of the machine. This arrangement also advantageously permits the handle 18 to be pivoted forwardly so that it rests on the casing 22 for storage and shipping.

The machine has two sets of wheels 13, 14, one located at the rear of the machine and the other located directly behind the buffing pad. When the machine is off, it is balanced so that it rests on all four wheels, and the buffing pad is raised above the floor and inclined at a slight angle a of about 6°–8° to the horizontal. See FIG. 9. When the machine is turned on, the vacuum effect created by the pad holder pulls the buffing pad onto the floor with a predetermined force, so that the pad applies the desired pressure on the floor surface. See FIG. 10. In that position, the weight of the machine is distributed between the buffing pad and the set of wheels located directly behind the pad. The rear wheels are raised above the floor.

Because the machine does not rest on the pad when not in use, the pad is less likely to become compressed during storage. In addition, when the machine is started, the pad is not in contact with the floor so that there is no, or a minimal, frictional load on the pad. Therefore, there is no initial power surge drawn by the motor when the machine is started.

The motor 16 is preferably a two horsepower motor wired for capacitive surge protection to reduce any surges or irregularities in its load requirements. With such motor, the buffing machine of the present invention using a twenty-inch X-shaped buffing pad is able to attain an average speed of about 2000 RPM, while drawing only about 15–18 amps of current under normal use, which current can be easily supplied by any household or commercial 110 volt wall outlet. At that speed, the X-shaped pad 28 is able to create enough friction and heat to melt the top layer of wax on the surface being buffed and provide a superior finish.

A conventional electric buffing machine, with a circular pad of comparable diameter, cannot operate satisfactorily at 2000 RPM with sufficient pressure to melt the floor wax with the power available from a standard 110 volt outlet. Because the pad 28 of the present invention is X-shaped, it has less surface area in contact with the floor than a circular pad of similar diameter. As a result of this reduced surface area, there is a net reduction in friction created by the rotation of the pad against the floor, allowing the X-shaped pad to be rotated at a greater speed than the conventional circular pad for a given amount of pressure on the floor by the pads. As explained above, the quality of the buff is dependent upon the speed of pad as well as the pressure exerted on the floor by the pad. Therefore, with less surface contact, the X-shaped pad is thus able to rotate at a faster speed with the same pressure and thus achieve a better surface finish.

The buffing pad and pad holder arrangements described above are most advantageously used with high speed buffing machines having a rotational speed of about 1000 RPM and greater. However, it is possible to advantageously use the inventive buffing pad arrangements with conventional floor buffing machines which operate at speeds lower than about 1000 RPM or in the range of about 175–1000 RPM. While such conventional floor buffing machines cannot achieve the quality and quickness of buffing that can be attained by the present invention, significant improvements in time and quality can be achieved.

Although the invention has been described in use with a buffing machine having a 110-volt electric motor, the invention is equally advantageous when applied to buffing machines powered by any means, such as a battery-powered motor, a 220-volt electric motor or a petroleum-fueled engine.

In the case of the high speed floor buffing machine which uses a petroleum-fueled engine, one problem that existed heretofore is solved by the present invention. Prior art machines could not be left unattended, even momentarily, without disengaging the pad drive, shutting down the engine or manually shifting the buffing machine to raise the pad from the floor. According to the present invention, the idle speed of the engine is selected so that the vacuum effect described above will not be sufficient to maintain the pad in the floor-engaging position shown in FIG. 9, but will permit the machine to assume the off-the-floor position of FIG. 8. Thus, if the operator wishes to leave the machine for a moment, e.g., to move a piece of furniture or equipment from an area to be buffed, he need only shift the fuel control to idle and the machine will automatically pivot to the FIG. 8 position. When the operator wishes to resume buffing, he only needs to shift the fuel control to increase engine RPM thereby pivoting the machine to the FIG. 9 position.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A buffing machine for buffing waxed floors and the like, comprising:

a chassis;

means mounted to the chassis for moving the chassis on a floor;

a motor mounted on said chassis;

a buffing pad holder drivably engaged to said motor and rotated by said motor at a predetermined rotational speed;

a buffing pad having a plurality of radial buffing elements in an X-shape attached to said buffing pad holder, said buffing pad holder having a substantially concave surface for engaging the buffing pad such that only outermost peripheral portions of the buffing elements engage the floor in buffing relation.

2. A buffing machine according to claim 1 wherein said predetermined rotational speed is 175–1000 RPM.

3. A buffing machine for buffing waxed floors and the like, comprising:

a chassis;

front wheel means and rear wheel means mounted on said chassis in a first plane for supporting said chassis, the axis of said front wheel means being parallel to and spaced from the axis of said rear wheel means;

a motor mounted on said chassis;

means for controlling the rotational speed of said motor between a first speed and a second speed;

a buffing pad holder drivably engaged to said motor, said pad holder being mounted in a second plane inclined with respect to the first plane; and a buffing pad mounted to the pad holder; and means responsive to the speed of said motor for pivoting said buffing machine from a first position at said first speed wherein the front and rear wheel means are in contact with the floor and the buffing pad is off the floor to a second position at said second speed wherein the front wheel means and buffing pad are in contact with the floor and the rear wheel means is off the floor.

4. A buffing machine according to claim 3, wherein said pivoting means comprises means on the buffing pad holder for creating a suction force proportional to the speed of said motor which urges the buffing machine from said first position to said second position when the speed of said motor is changed from said first speed to said second speed.

5. A buffing machine according to claim 4, wherein said motor is an electric motor, said first speed being zero RPM and said second speed being greater than 1000 RPM.

6. A buffing machine according to claim 3, wherein said motor is a petroleum-fueled engine and said second speed is greater than said first speed, said first speed being an idle speed of said engine.

* * * * *